US008133035B2

(12) United States Patent
Wolff

(10) Patent No.: US 8,133,035 B2
(45) Date of Patent: Mar. 13, 2012

(54) METHOD FOR CONTROLLING THE CAPACITY OF A PERISTALTIC PUMP AND PERISTALTIC PUMP

(75) Inventor: Remy Wolff, Morette (FR)

(73) Assignee: Fresenius Vial SAS, Brezins (FR)

( * ) Notice: Subject to any disclaimer, the term of this patent is extended or adjusted under 35 U.S.C. 154(b) by 423 days.

(21) Appl. No.: 12/513,773

(22) PCT Filed: Oct. 26, 2007

(86) PCT No.: PCT/EP2007/061550

§ 371 (c)(1),
(2), (4) Date: May 6, 2009

(87) PCT Pub. No.: WO2008/055794

PCT Pub. Date: May 15, 2008

(65) Prior Publication Data

US 2010/0021315 A1 Jan. 28, 2010

(30) Foreign Application Priority Data

Nov. 8, 2006 (FR) ..... 06 09754

(51) Int. Cl.
*F04B 43/12* (2006.01)

(52) U.S. Cl. ..... 417/53; 417/476

(58) Field of Classification Search ..... 417/53, 417/414, 476; 166/105, 68; 415/230, 901
See application file for complete search history.

(56) References Cited

U.S. PATENT DOCUMENTS

| | | | |
|---|---|---|---|
| 6,585,499 | B2 | 7/2003 | Nguyen et al. |
| 6,666,665 | B1 | 12/2003 | Nguyen et al. |
| 2002/0061255 | A1 | 5/2002 | Nguyen et al. |
| 2003/0192919 | A1 | 10/2003 | Nguyen et al. |

FOREIGN PATENT DOCUMENTS

| | | | |
|---|---|---|---|
| EP | 0484717 | A1 | 5/1992 |
| EP | 0872252 | A1 | 10/1998 |
| FR | 2553151 | A1 | 4/1985 |
| GB | 2150644 | A | 7/1985 |
| WO | 00/51670 | A1 | 9/2000 |

OTHER PUBLICATIONS

International Search Report of PCT/EP2007/061550, date of mailing Dec. 3, 2007.

*Primary Examiner* — Karabi Guharay
*Assistant Examiner* — Elmito Breval
(74) *Attorney, Agent, or Firm* — Westerman, Hattori, Daniels & Adrian, LLP

(57) ABSTRACT

A method for controlling the flow rate of a peristaltic pump includes compressing a flexible tube, forming at least one occlusion region that moves cyclically downstream from the upstream end of the pump, and compressing the tube in the direction of a counter surface to form an occlusion. A peristaltic pump can be used to carry out the method so as to suppress reverse flow without altering the speed of the motor. The occlusion in the most downstream part of the pump remain in the occluding position for a longer portion of the cycle than the occlusion in a more upstream part of the pump, preferably for longer than the compression in the most upstream part of the pump.

29 Claims, 3 Drawing Sheets

METHOD FOR CONTROLLING THE CAPACITY OF A PERISTALTIC PUMP AND PERISTALTIC PUMP

Figure 1:
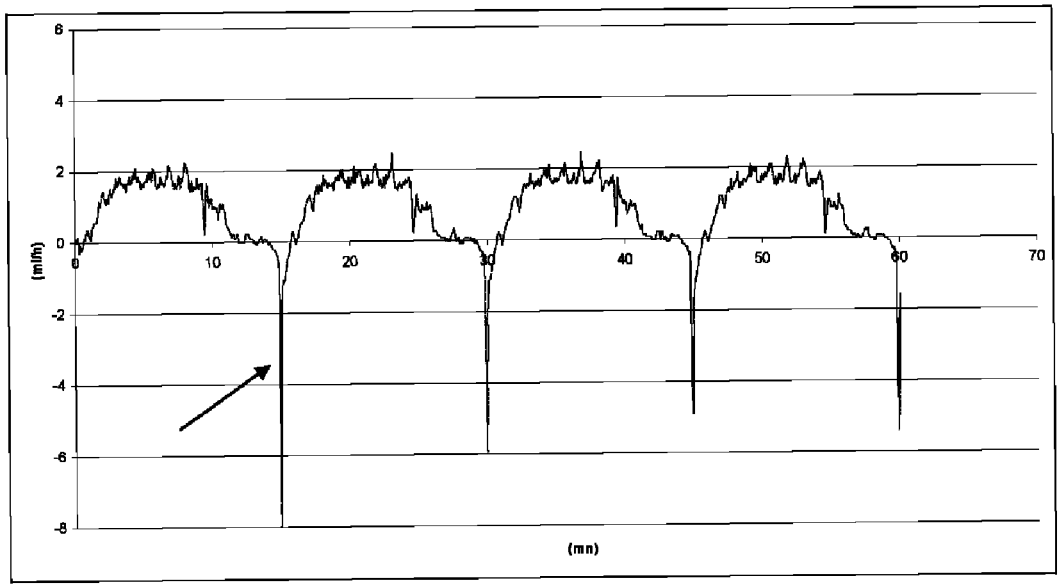

The invention relates to a method for controlling the flow rate in a peristaltic pump comprising occlusion means for compressing a flexible tube, creating at least one zone of occlusion moving cyclically from an upstream part to a downstream part of the pump, the occlusion means comprising mobile compression means that compress the tube toward a counter surface, the occlusion means being actuated by control means placed on a rotation shaft. The invention also relates to a peristaltic pump for carrying out the method.

Such peristaltic pumps are commonly used in the medical field, particularly for perfusion. They have the advantage of delivering to the patient a relatively constant volume of the liquid to be perfused with good reliability.

There are two basic types of peristaltic pumps: roller pumps and finger pumps.

Roller pumps are generally made of two to four rollers placed on a roller carrier driven rotationally by a motor. A flexible tube is placed in an arc-shaped raceway. Moving rotationally, the rollers flatten the tube in the raceway, generating a suction zone behind them and a compression zone in front of them. In order to operate, there must always be an occlusion zone; in other words, at least one of the rollers is always pressing on the tube.

Finger pumps are made of a series of fingers moving in cyclical fashion to flatten a flexible tube against a counter surface. The fingers move essentially vertically, in wave-like fashion, forming a zone of occlusion that moves from upstream to downstream. The last finger—the furthest downstream—raises up when the first finger—the furthest upstream—presses against the counter surface. The most commonly used finger pumps are linear, meaning that the counter surface is flat and the fingers are parallel. In this case, the fingers are controlled by a series of cams arranged one behind another, each cam cooperating with a finger. These cams are placed helically offset on a shared shaft driven rotationally by a motor. There are also curvilinear finger pumps, which attempt to combine the advantages of roller pumps with those of finger pumps. Pumps of this kind are found in documents EP 1 13 609 A1 and U.S. Pat. No. 5,575,631 A, for example. In this type of pump, the counter surface is not flat, but arc-shaped, and the fingers are arranged radially inside the counter surface. In this case, a shared cam with multiple knobs placed in the center of the arc is used to activate the fingers.

These peristaltic pumps have a major disadvantage: the flow of pumped liquid is not quite consistent, primarily in that it exhibits what is called a "backflow", meaning that there is suction of the liquid from the downstream toward the upstream part at the very moment when the cycle starts over. That is, at the end of each cycle, the fingers furthest downstream pull back, which creates suction, while the fingers furthest upstream go forward, which initiates pumping action, but for a brief instant, suction is greater than pumping action. From a therapeutic standpoint, this is an undesirable phenomenon.

To counter this phenomenon, it is common practice to accelerate the pump action in the zone of the cycle being disrupted by this phenomenon. This solution requires special control of the pump, which is relatively complicated.

The objective of the invention, then, is to develop peristaltic pumps according to the preamble and their control method for preventing backflow without altering the speed of the motor.

This objective is achieved according to the invention due to the fact that the occlusion means in the furthest downstream part of the pump remain in the occlusive position for a greater portion of the cycle than the occlusion means in a more upstream part of the pump, and preferably than the compression means in the furthest upstream part of the pump. In this way, it is certain that no backflow can occur. This can easily be achieved by not removing the zone of occlusion downstream until the new zone of occlusion upstream has begun to move downstream. This design guarantees that the liquid already downstream of the pump cannot be sucked back into the section of tubing located in the pump. In practice, the zone of occlusion in the furthest downstream position is not removed until the pressure in the section of tubing directly upstream of this zone of occlusion is equal to or greater than the pressure in the section of tubing directly downstream of this occlusion. Even though it is not easy to measure the pressure in the part of the tubing located in the peristaltic pump, it is possible at least to proportion the pump in such a way that the pressure difference between the section of tubing located directly upstream of this zone of occlusion and the section of tubing located directly downstream of this occlusion is positive at the moment the occlusion is removed. This results in a pressure peak in the pressure curve recorded downstream of the pump.

The peristaltic pump with which this method can be used is equipped with corresponding means. A simple way to achieve this occlusion downstream for a greater portion of the cycle is to bring the counter surface of the rotation shaft of the compression means control means closer at its most downstream point than it is at another point: preferably, than it is at its most upstream point.

This inventive concept applies particularly to finger pumps. In this case, the control means for the finger furthest downstream are proportioned in order to keep said finger in the occlusive position for a greater portion of the cycle than the other fingers, particularly than the finger furthest upstream. In particular, the control means for the finger furthest downstream can be proportioned so as to keep said finger in the occlusive position when the finger furthest upstream is going into the occlusive position.

In a first embodiment, the method is applied to a pump with linear fingers. In a first alternative embodiment, firstly, the counter surface is flat, and secondly, the counter surface and the rotation shaft of the control means for the fingers are closer together in the downstream zone than in the upstream zone of the pump. This can be embodied by having the counter surface inclined with respect to the plane perpendicular to the fingers. It is also possible for the counter surface to be perpendicular to the fingers while the rotation shaft of the control means for the fingers is inclined with respect to the plane perpendicular to the fingers.

In another alternative embodiment of the invention, the counter surface between the finger furthest upstream and the finger furthest downstream is concave.

In a second embodiment of the invention, the method is applied to a curvilinear finger pump. In this case, the downstream end of the counter surface is closer to the rotation shaft of the control cam for the fingers than another point of the counter surface, preferably than the upstream end of the counter surface. This can easily be achieved by giving the counter surface a spiral arc shape whose center coincides with the rotation shaft of the control cam for the fingers.

Instead of bringing the downstream end of the counter surface of the rotation shaft of the control means closer, or in addition to this, the finger furthest downstream can also be made longer than one of the other fingers, preferably than the finger furthest upstream.

For a straightforward implementation of the method, it is preferable to have the control means for the finger furthest downstream—e.g., a cam—equipped with means for enabling a spring to compress said finger toward the counter surface for a part of the cycle without allowing the rotation of the shaft of the control means to make said finger move.

It has been found in practice that the height, which is defined as being the difference between a) the distance between the point of the counter surface closest to the rotation shaft of the control means for the fingers and said rotation shaft and b) the distance between the point of the counter surface furthest from the rotation shaft of the control means for the fingers and said shaft, should preferably be between one-tenth and one-half of the inside diameter of the flexible tubing for which the pump is provided; preferably the height is equal to approximately one-fifth of the inside diameter.

So that the pump can be used with tubes of different diameters, it is preferable that the counter surface be equipped with means for changing its longitudinal orientation and/or that it be removable and replaceable.

The concept of the invention can also be applied to roller pumps.

The invention is described in more detail below with the help of an exemplary embodiment. The figures show:

FIG. 1: Curve of the flow rate observed for a pump with linear fingers without acceleration.

Figure 2:
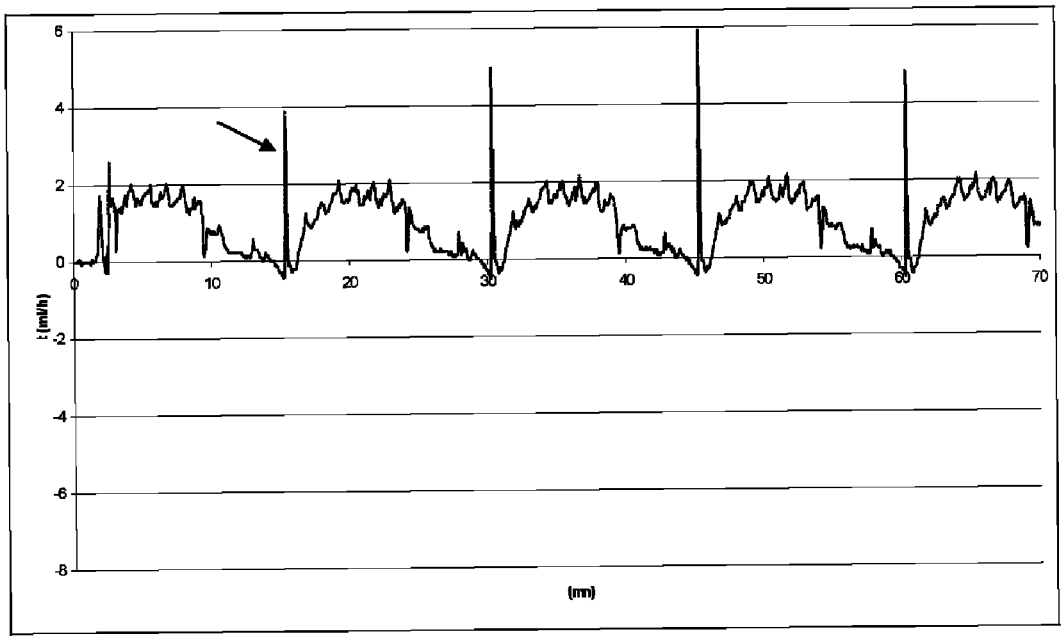
Figure 3:
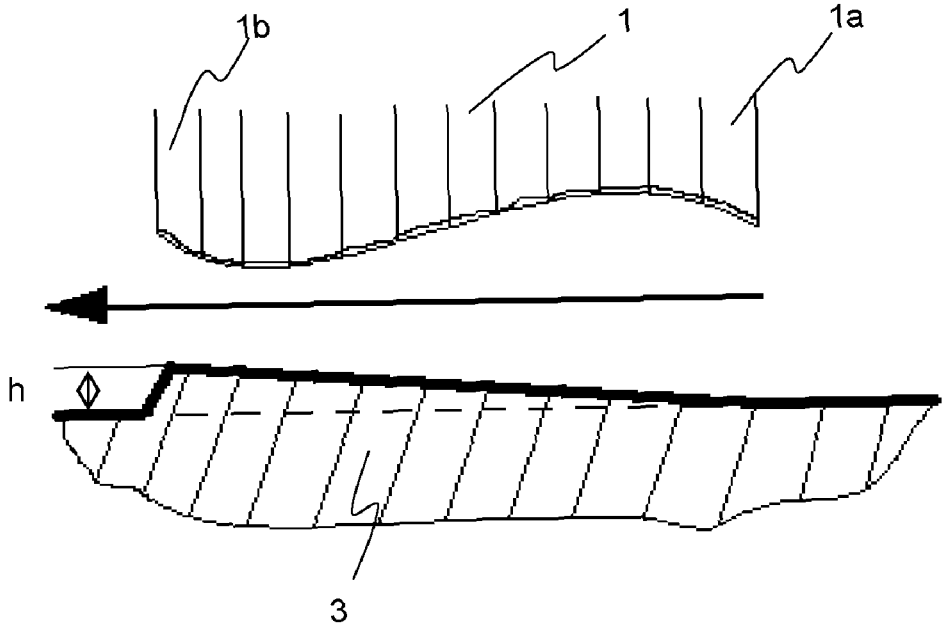
Figure 4:
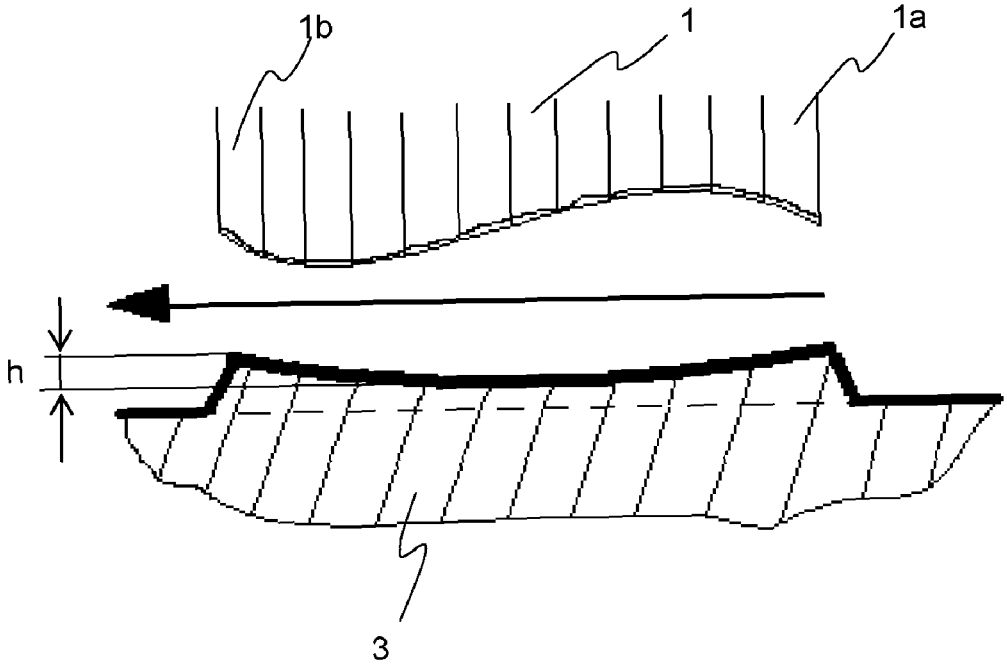
Figure 5:
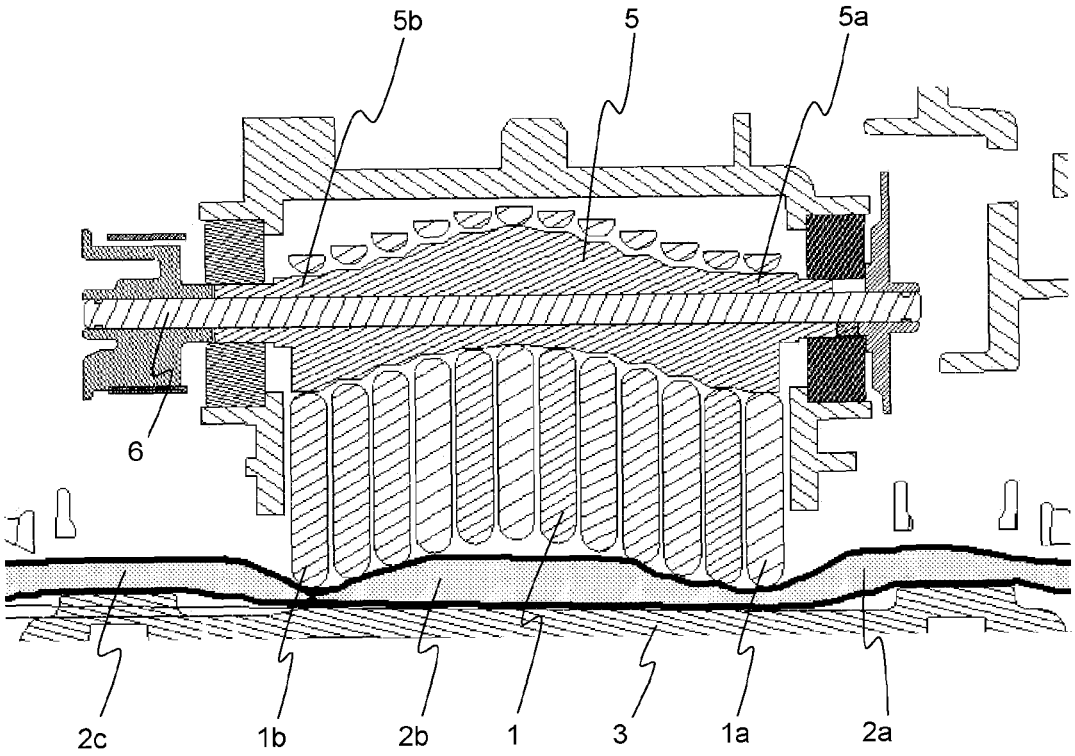
Figure 6:
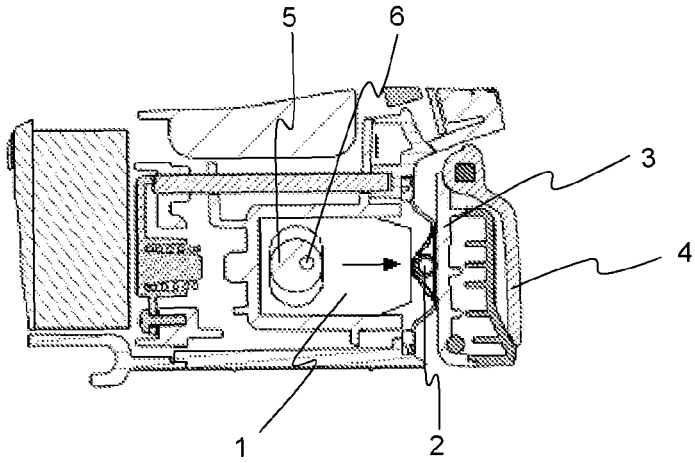

FIG. 2: Curve of the flow rate observed for a pump with linear fingers according to the invention, without acceleration;

FIG. 3: Side view of a first example of an embodiment of a counter surface according to the invention;

FIG. 4: Side view of a second example of an embodiment of a counter surface according to the invention;

FIG. 5: Top view longitudinal section through a pump with linear fingers according to the invention;

FIG. 6: Side view transverse section of the pump in FIG. 5.

In the embodiment given below, the peristaltic pump is a traditional linear pump with fingers. It consists of a series of fingers (1) that act as mobile compression means to flatten a tube (2) against a counter surface (3). This counter surface is placed in the door (4) of the pump.

A series of cams (5) is placed on a shaft (6). These cams (5), as control means activating the mobile compression means, are made of cylinder sections, for example, mounted off-center on the shaft (6) and angularly offset from one another so that each finger's movement is slightly later than the previous one and slightly earlier than the following one.

In the state of the art, the fingers are all the same length, the counter surface is parallel to the cam shaft and each finger remains in the occlusive position for an identical portion of the cycle. The aforementioned backflow phenomenon occurs at the end of the cycle, clearly seen in FIG. 1. FIG. 1 shows the instantaneous flow rate (ml/h) as a function of time given in minutes. The arrow shows the backflow. The liquid thus suctioned from the section (2*c*) of the tube downstream of the pump partly fills the section of the tube (2*b*) inside the pump, reducing the volume of liquid pumped from the section (2*a*) upstream of the pump by that amount. To counteract this phenomenon, in the state of the art the rotation speed of the shaft is accelerated when the transition between two cycles occurs, i.e., at the moment when the finger furthest downstream leaves the occlusive position and the finger furthest upstream goes into the occlusive position. With this technique, this portion of the cycle is accelerated, although its angular section is the same as the others.

By contrast, the invention specifies that the finger furthest downstream (1*b*) remains in the occlusive position for a greater portion of the cycle than the other fingers, giving the occlusion that is forming upstream time to begin moving forward. This way, the pressure in the section (2*b*) of tubing between the two occlusions increases, and the downstream occlusion is removed only when this pressure becomes equal to or greater than the pressure in the section (2*c*) downstream of the pump. With this solution, we obtain a flow rate curve like the one shown in FIG. 2. It can be seen that the backflow has completely disappeared, and that it has been replaced by a pumping peak indicated by the arrow, which is preferable from a clinical standpoint. Moreover, the volume pumped in each cycle is greater, because the section (2*b*) of tubing inside the pump is filled only with liquid coming from the upstream end of the pump. Therefore, the pump has better efficiency. This results in reduced energy consumption, a smaller sized motor, and less operating noise.

If we take the example of a peristaltic pump with 12 fingers and divide the cycle into a series of angular sections, the portion of the cycle in which one finger is in the occlusive position would be in the order of 360°/12, or 30°, in state-of-the-art pumps. By contrast, in the method according to the invention, variable angular sections will be selected that can overlap, at least in some cases. For example, one could select a 27° section for the finger furthest upstream (1*a*) and a 33° section for the finger furthest downstream (1*b*), with these two sections partially overlapping.

This result can be obtained in various ways, which can be combined if needed.

The simplest approach consists in using a counter surface that is inclined with respect to the rotation shaft (6) of the control cams (5) for the fingers (1). This is what the example in FIG. 3 shows. Here, the rotation shaft (6) is perpendicular to the fingers (1), while the counter surface is off-perpendicular to the fingers. For clarity's sake, the inclination shown in FIG. 3 is exaggerated. The fingers (1) are activated by the cams (5) while being acted on by a spring (7) designed to push them closer to the counter surface (3). The cams are designed so that the fingers can remain in the occlusive position for a portion of the cycle that increases the further downstream they are in the pump.

In practice, the finger furthest upstream (1*a*) has to drop further down to begin to act on the tubing (2) and compress it than the finger furthest downstream (1*b*). Consequently, it remains in the occlusive position for a briefer cycle portion than the latter. When the cam shaft (6) rotates, it drives the cam (5*b*) for the finger (1*b*) furthest downstream, bringing it toward the counter surface (3) until it compresses the tube (2) thereagainst. The cam (5*b*) continues to rotate without driving the finger, which is held in this position by the spring (7) loading. Past a certain shaft (6) rotation angle, the cam (5*b*) again begins to displace the finger (1*b*), this time upwards against the spring (7) loading. In order to have the upstream finger (1*a*) compress the tubing (2), it will necessarily have traveled a greater distance than the downstream finger (1*b*), due to the inclination of the counter surface. While the finger (1*b*) furthest downstream is still in the occlusive position, the finger furthest upstream (1*a*) reaches the occlusive position. In other words, the portion of the cycle in which the finger furthest downstream (1*b*) is in the occlusive position overlaps the portion of the cycle in which the finger furthest upstream (1*a*) takes its turn in the occlusive position. The further downstream the fingers are placed in the pump, the greater the portion of the cycle in which they are in the occlusive position, and the more their control resembles that of the finger furthest downstream (1*b*).

In practice, it has been found that it is preferable to select a height (h) between the highest end (downstream) and the lowest end (upstream) as a function of the inside diameter of the flexible tubing (2). Very good results have been obtained with a height between one-tenth and one-half of the inside diameter of the tubing (2), with the best results being obtained with a height equal to approximately one-fifth of the inside diameter.

So that the pump can be used with tubes of different inside diameters, it is preferable to have the counter surface (3) be removable and replaceable with another counter surface at a different inclination. Another solution is to provide means to increase or decrease the inclination of the counter surface (3) as a function of the tubing (2) being used.

Another solution is to provide a concave counter surface (3) like the one shown in FIG. 4. In this embodiment, the portion of the cycle during which both the upstream and downstream fingers are in the occlusive position is greater than the portion of the cycle for the fingers placed in the center.

Rather than inclining the counter surface (3), the pump fingers can also have different lengths. The further downstream they are in the pump, the longer the fingers. This way, the portion of the cycle in which the finger furthest downstream (1*b*) will be in contact with the counter surface will be greater than the portion of the cycle for the finger furthest upstream (1*a*).

Another solution is to incline the cam shaft (6) so that it is closer to the counter surface (3) in a downstream part than in an upstream part of the pump. In this case, the counter surface (3) is perpendicular to the fingers, as in the state of the art, but the rotation shaft (6) of the control means (5) for the fingers is off-perpendicular to the fingers. This way, as in the case of the inclined counter surface, the finger furthest downstream (1*b*) will flatten the tube (2) sooner and will compress it longer, so that it will still be in the occlusive position when the upstream finger (1*a*) goes into the occlusive position.

It is important to clearly distinguish between the occlusion period (a time-related notion) of the various fingers and the portion of the cycle during which these fingers are in the occlusive position. If the motor rotation speed—and thus the rotation shaft (6) speed—is constant, the downstream finger (1*b*) remains in the occlusive position longer than the upstream finger (1*a*), since the portion of the cycle in which this downstream finger (1*b*) is in this position is greater than that for the upstream finger (1*a*). However, in practice, it can be advantageous to accelerate the motor speed cyclically at the moment when the downstream finger (1*b*) is in the occlusive position. That way, the run time is decreased for the portion of the cycle corresponding to the occlusion of this finger (1*b*), a moment at which the flow rate is practically zero. Whereas in the state of the art, this acceleration serves to reduce backflow, for the purposes of the invention it serves to reduce the run time of the portion of the cycle in which the flow rate is close to zero. Because of this cyclical acceleration, it is entirely possible that the downstream finger (1*b*) will remain in the occlusive position for less time than the other fingers, and particularly than the upstream finger (1*a*).

The same principle can be applied to pumps with curvilinear fingers. Here as well, the finger furthest downstream must not be withdrawn until the pressure inside the section of tubing placed in the pump is at least equal to the pressure in the section of tubing downstream. A first solution is to bring the counter surface of the cam closer in the downstream part. In other words, instead of being arc shaped, the counter surface will be helical, approaching the cam steadily as it approaches the downstream zone of the pump. Rather than a helical shape, it is possible to position the arc of the counter surface off center with respect to the rotation shaft of the cam, from which the fingers extend radially. No matter which solution is selected, here as well, the fingers will be controlled by making a spring cooperate with the cam.

As in the pumps with linear fingers, another solution is to make the fingers located downstream longer than the fingers located upstream.

Finally, the same principle can be applied to peristaltic roller pumps.

The invention claimed is:

1. Method for controlling the flow rate in a peristaltic pump comprising occlusion means for compressing a flexible tube, creating at least one zone of occlusion moving cyclically from an upstream part to a downstream part of the pump, the occlusion means comprising mobile compression means that compress the tube toward a counter surface, the occlusion means being actuated by control means placed on a rotation shaft, wherein the occlusion means in the furthest downstream part of the pump remain in the occlusive position for a greater portion of the cycle than the occlusion means in a further upstream part of the pump, wherein the zone of occlusion downstream is not removed until the pressure in the section of tubing directly upstream of this zone of occlusion is equal to or greater than the pressure in the section of tubing directly downstream of this occlusion.

2. Method according to claim 1, wherein the zone of occlusion downstream is not removed until the new zone of occlusion upstream has begun to move downstream.

3. Peristaltic pump comprising occlusion means for compressing a flexible tube, creating at least one zone of occlusion able to move cyclically from an upstream part to a downstream part of the pump, the occlusion means comprising mobile compression means that compress the tube toward a counter surface, the occlusion means being actuated by control means placed on a rotation shaft, wherein the counter surface at its furthest downstream point in the pump is closer to the rotation shaft of the control means of the compression means than it is at another point.

4. Peristaltic pump according to claim 3, wherein the control means for the compression means are proportioned so as to remove the zone of occlusion in the downstream part of the pump only when the new zone of occlusion in the upstream part has begun to move downstream.

5. Peristaltic pump according to claim 3, wherein the control means for the compression means are proportioned so as to remove the zone of occlusion in the furthest downstream part of the pump only when the pressure in the section of the tubing directly upstream of this zone of occlusion is equal to or greater than the pressure in the section of tubing directly downstream of this occlusion.

6. Peristaltic pump according to claim 3, wherein the control means for the compression means are proportioned so as to keep said compression means in the occlusive position in the furthest downstream part of the pump for a greater portion of the cycle than a further upstream part of the pump.

7. Peristaltic pump according to claim 3, wherein the pump is a finger pump.

8. Peristaltic pump according to claim 7, wherein the control means for the finger furthest downstream are proportioned so as to keep said finger in the occlusive position for a greater portion of the cycle than the finger furthest upstream.

9. Peristaltic pump according to claim 7, wherein the control means for the finger furthest downstream are proportioned so as to keep said finger in the occlusive position when the finger furthest upstream is going into the occlusive position.

10. Peristaltic pump according to claim 7, wherein the counter surface is flat, and in that the counter surface and the rotation shaft of the control means for the fingers are closer together in the downstream zone than in the upstream zone of the pump.

11. Peristaltic pump according to claim 10, wherein the counter surface is inclined with respect to the plane perpendicular to the fingers.

12. Peristaltic pump according to claim 10, wherein the counter surface is perpendicular to the fingers and the rotation shaft of the control means for the fingers is inclined with respect to the plane perpendicular to the fingers.

13. Peristaltic pump according to claim 7, wherein the counter surface between the finger furthest upstream and the finger furthest downstream is concave.

14. Peristaltic pump according to claim 7, wherein the finger pump is curvilinear, and the downstream end of the counter surface is closer to the rotation shaft of the control cam for the fingers than another point of the counter surface.

15. Peristaltic pump according to claim 14, wherein the counter surface has a spiral arc shape whose center coincides with the rotation shaft of the control cam for the fingers.

16. Peristaltic pump according to claim 7, wherein the finger furthest downstream is longer than one of the other fingers.

17. Peristaltic pump according to claim 7, wherein the control means for the finger furthest downstream are equipped with means for enabling a spring to compress said finger toward the counter surface for a part of the cycle without allowing the rotation of the shaft of the control means to make said finger move.

18. Peristaltic pump according to claim 3, wherein the height, which is defined as being the difference between a) the distance between the point of the counter surface closest to the rotation shaft of the control means for the fingers and said rotation shaft and b) the distance between the point of the counter surface furthest from the rotation shaft of the control means for the fingers and said shaft, is between one-tenth and one-half of the inside diameter of the flexible tubing for which the pump is provided.

19. Peristaltic pump according to claim 3, wherein the counter surface is equipped with means for changing its longitudinal orientation.

20. Peristaltic pump according to claim 3, wherein the pump is a roller pump.

21. Method according to claim 1, wherein the occlusion means in the furthest downstream part of the pump remain in the occlusive position for a greater portion of the cycle than the compression means in the furthest upstream part of the pump.

22. Peristaltic pump according to claim 8, wherein the control means for the finger furthest downstream are proportioned so as to keep said finger in the occlusive position for a greater portion of the cycle than the other fingers.

23. Peristaltic pump according to claim 14, wherein the finger pump is curvilinear, and the downstream end of the counter surface is closer to the rotation shaft of the control cam for the fingers than the upstream end of the counter surface.

24. Peristaltic pump according to claim 18, wherein the height, which is defined as being the difference between a) the distance between the point of the counter surface closest to the rotation shaft of the control means for the fingers and said rotation shaft and b) the distance between the point of the counter surface furthest from the rotation shaft of the control means for the fingers and said shaft, is equal to approximately one-fifth of the inside diameter.

25. Peristaltic pump according to claim 3, wherein the counter surface is removable and replaceable.

26. Peristaltic pump comprising occlusion means for compressing a flexible tube, creating at least one zone of occlusion able to move cyclically from an upstream part to a downstream part of the pump, the occlusion means comprising mobile compression means that compress the tube toward a counter surface, the occlusion means being actuated by control means placed on a rotation shaft, wherein the control means for the compression means are proportioned so as to keep said compression means in the occlusive position in the furthest downstream part of the pump for a greater portion of the cycle than a further upstream part of the pump, wherein the pump is a finger pump.

27. Peristaltic pump according to claim 3, wherein the control means for the compression means are proportioned so as to keep said compression means in the occlusive position in the furthest downstream part of the pump for a greater portion of the cycle than said compression means in the furthest upstream point of the pump.

28. Peristaltic pump according to claim 3, wherein the counter surface at its furthest downstream point in the pump is closer to the rotation shaft of the control means of the compression means than it is at its furthest upstream point.

29. Peristaltic pump according to claim 7, wherein the finger furthest downstream is longer than the finger furthest upstream.

* * * * *